US010040616B2

(12) United States Patent
Futase

(10) Patent No.: US 10,040,616 B2
(45) Date of Patent: Aug. 7, 2018

(54) PACKAGING BAG

(71) Applicant: YUSHIN CO., LTD., Niigata (JP)

(72) Inventor: Katsunori Futase, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 0 days.

(21) Appl. No.: 15/305,785

(22) PCT Filed: Jun. 3, 2015

(86) PCT No.: PCT/JP2015/065996

§ 371 (c)(1),
(2) Date: Oct. 21, 2016

(87) PCT Pub. No.: WO2016/006369

PCT Pub. Date: Jan. 14, 2016

(65) Prior Publication Data

US 2017/0043927 A1 Feb. 16, 2017

(30) Foreign Application Priority Data

Jul. 8, 2014 (JP) ..... 2014-140352
Aug. 28, 2014 (JP) ..... 2014-173704

(51) Int. Cl.
*B65D 30/24* (2006.01)
*B65D 75/58* (2006.01)

(52) U.S. Cl.
CPC ..... *B65D 75/5822* (2013.01); *B65D 75/5816* (2013.01); *B65D 75/5866* (2013.01); *B65D 2575/586* (2013.01)

(58) Field of Classification Search
CPC ..... B65D 75/5822; B65D 75/5816; B65D 75/5866; B65D 2575/586
(Continued)

(56) References Cited

U.S. PATENT DOCUMENTS 4,974,732 A * 12/1990 Sullivan ..... B65D 75/008 206/484
4,988,016 A * 1/1991 Hawkins ..... B65D 75/30 222/107
(Continued)

FOREIGN PATENT DOCUMENTS

CN 1185401 12/1996
CN 2534112 1/2002
(Continued)

OTHER PUBLICATIONS

Machine translation of the description of JP 2000043902 A.*
(Continued)

*Primary Examiner* — Jes F Pascua
(74) *Attorney, Agent, or Firm* — Greenblum & Bernstein, P.L.C.

(57) ABSTRACT

In a package bag having a package bag body formed by joining laminate films each including a base film layer and a sealant layer through fusion of the opposed sealant layers and a film-shaped pouring nozzle having a self-sealing function formed by fusion-joining laminate films each including front and rear sealant layers sandwiching a base film layer at their peripheral portions other than base end portions wherein the base end portion of the film-shaped pouring nozzle is fusion-joined to a top of the package bag body, the film-shaped pouring nozzle is constructed with an inclined part located at a side of the base end portion so as to protrude from an upper end portion of the package bag body obliquely upward in a direction of a side portion thereof and a horizontal part connected to a side of a free end portion of the inclined part.

8 Claims, 5 Drawing Sheets

(58) Field of Classification Search
USPC ..... 383/200, 207–209, 44, 906
See application file for complete search history.

(56) References Cited

U.S. PATENT DOCUMENTS

| | | | | | |
|---|---|---|---|---|---|
| 5,005,734 | A * | 4/1991 | Van Gordon | B65D 33/00 | 222/107 |
| 5,251,982 | A * | 10/1993 | Stenstrom | A61J 1/10 | 206/438 |
| 8,381,948 | B1 * | 2/2013 | Jian | B65D 75/5811 | 222/107 |
| 2003/0146247 | A1 * | 8/2003 | Oren | B65D 5/748 | 222/494 |
| 2008/0264970 | A1 | 10/2008 | Kasai | | |
| 2011/0042412 | A1 * | 2/2011 | Kasai | B65D 75/5866 | 222/107 |
| 2014/0217119 | A1 | 8/2014 | Futase | | |
| 2015/0197379 | A1 * | 7/2015 | Otsuka | B65D 75/5822 | 222/541.6 |
| 2016/0214748 | A1 * | 7/2016 | Futase | B65B 7/02 | |
| 2017/0043926 | A1 * | 2/2017 | Futase | B65D 75/5883 | |

FOREIGN PATENT DOCUMENTS

| | | | | |
|---|---|---|---|---|
| CN | 1646380 | | 7/2005 | |
| CN | 101014507 | | 8/2007 | |
| CN | 103732506 | | 4/2014 | |
| JP | 62-108238 | | 7/1987 | |
| JP | 08-230906 | | 9/1996 | |
| JP | 11-029174 | | 2/1999 | |
| JP | 11321923 | A * | 11/1999 | |
| JP | 2000043902 | A * | 2/2000 | |
| JP | 2002-160744 | | 6/2002 | |
| JP | 2002193282 | A * | 7/2002 | |
| JP | 2004-175439 | | 6/2004 | |
| JP | 2004175439 | A * | 6/2004 | |
| JP | 2005-015029 | | 1/2005 | |
| JP | 2005-059958 | | 3/2005 | |
| JP | 2008018991 | A * | 1/2008 | |
| JP | 2010-260614 | | 11/2010 | |
| JP | 2011-046394 | | 3/2011 | |
| JP | 2011-178458 | | 9/2011 | |
| JP | 2011184065 | A * | 9/2011 | |
| JP | 2011-207484 | | 10/2011 | |
| JP | 2011255946 | A * | 12/2011 | |
| JP | 2012081983 | A * | 4/2012 | |
| JP | 2012176782 | A * | 9/2012 | |
| JP | 2015117063 | A * | 6/2015 | |
| JP | 2016193754 | A * | 11/2016 | |
| JP | 2016204050 | A * | 12/2016 | |
| JP | 2017039548 | A * | 2/2017 | |
| JP | 2017052562 | A * | 3/2017 | |
| JP | 2017100767 | A * | 6/2017 | |
| JP | 2017121937 | A * | 7/2017 | B65B 61/02 |
| WO | WO 8802339 | A1 * | 4/1988 | B29C 51/267 |

OTHER PUBLICATIONS

International Preliminary Report on Patentability issued in PCT/JP2015/065996, dated Jan. 10, 2017, with English language translation thereof.

International Search Report issued in PCT/JP2015/065996, dated Sep. 1, 2015.

Office Action issued in China Counterpart Patent Appl. No. 201580035375.4 , dated Mar. 20, 2018.

* cited by examiner

PACKAGING BAG

TECHNICAL FIELD

This invention relates to a package bag provided with a film-shaped pouring nozzle having a self-sealing function.

RELATED ART

In Patent Documents 1 and 2 are disclosed package bags provided with a checking type film-shaped pouring nozzle. The feature of this film-shaped pouring nozzle lies in a checking function which prevents penetration of air (ambient air) into the inside of the package bag in an amount corresponding to a volume of a packed material poured from the package bag. That is, the checking type film-shaped pouring nozzle has a feature that when the pouring of the packed liquid material is stopped by contracting or crushing deformation of the package bag itself, a pouring path of the checking type pouring nozzle is automatically closed by the wetting action of the packed liquid material to develop a checking function (self-sealing function) preventing penetration of ambient air into the package bag.

According to the package bag, therefore, the penetration of ambient air into the package bag can be prevented before, during and after the pouring of the packed liquid material when the packed liquid material is poured from the bag.

Patent Document 1: JP-A-2005-15029

Patent Document 2: JP-A-2005-59958

SUMMARY OF THE INVENTION

Task to be Solved by the Invention

In the package bag provided with the checking type film-shaped pouring nozzle as disclosed in Patent Documents 1 and 2, the pouring of the packed liquid material is stopped by returning the package bag from a tilting posture to a standing posture, during which the pouring path of the checking type pouring nozzle is automatically closed by adhering inner faces of the path to each other through the wetting action of the packed liquid material.

In this case, the packed liquid material existing near to the top opening of the checking type pouring nozzle is divided into a material flowing backward to the inside of the package bag through the pouring path and a material pushing outward from the top opening. However, the packed liquid material pushed outward from the top opening adheres to the top opening without draining (dropping) sufficiently and falls downward therefrom or drips down from the lower end of the opening, which is a fear of contaminating the package bag and the surrounding thereof.

The invention is developed in view of the above problems inherent to the conventional package bag. It is an object of the invention to provide a package bag which cannot block the pouring property in the top opening of the pouring path when the pouring of the packed liquid material is stopped while keeping the self-sealing function of the conventional checking type pouring nozzle or can adjust minutely smooth pouring and a pouring amount and can prevent generation of liquid dripping while maintaining a good draining property.

Solution for Task

The inventor has made studies for achieving the above object and found out that it is effective to provide a package bag comprising a package bag body formed by joining laminate films each comprised of a base film layer and a sealant layer through fusion of the opposed sealant layers and a film-shaped pouring nozzle having a self-sealing function formed by fusion-joining laminate films each comprised of front and rear sealant layers sandwiching a base film layer at their peripheral portions other than base end portions to form a pouring path communicating to an inside of the package bag body wherein the base end portion of the film-shaped pouring nozzle is fusion-joined to a top of the package bag body, characterized in that the film-shaped pouring nozzle is constructed with an inclined part located at a side of the base end portion so as to protrude from an upper end portion of the package bag body obliquely upward in a direction of a side portion thereof and a horizontal part connected to a side of a free end portion of the inclined part and extending parallel to the upper end of the package bag body, and hence the invention has been accomplished.

In the package bag according to the invention, the following constructions can provide more preferable solution means:

(1) The inclined part has an angle θ between a widthwise central line of the pouring path and the upper end of the package bag body of 25-70°;

(2) The horizontal part is provided with a notch or a tear-guiding scar for opening a poring port in the vicinity of a tip portion located at a side opposite to the inclined part;

(3) A shape of an opened end of the horizontal part formed by tearing the vicinity of the tip portion located at a side opposite to the inclined part is straight or curved;

(4) The opened end is concave at its both end portions and convex at its central portion with respect to a pouring direction of a packed liquid material;

(5) A ratio of an opening width in the horizontal part formed by tearing the tip portion located at a side opposite to the inclined part to a path width of the pouring path at the base end portion of the film-shaped pouring nozzle is within a range of 1:1 to 1:10;

(6) The film-shaped pouring nozzle is provided in a boundary portion between the inclined part and the horizontal part or in the vicinity thereof with a folded part for temporarily stopping a packed liquid material flown into the inclined part to prevent leakage thereof in an unexpected occurrence under an unpressed condition;

(7) The film-shaped pouring nozzle is provided in a position of either the horizontal part or the inclined part or in a boundary thereof with a leakage-preventing pleat of at least one concave-convex formed by bending the laminate films extended in a direction across the pouring path in a zigzag form.

Effect of the Invention

The package bag according to the invention is good in the liquid draining property at the opened end because the checking type film-shaped pouring nozzle having a self-sealing function (hereinafter referred to as "pouring nozzle" simply) is arranged so as to protrude from the upper end portion of the package bag body obliquely upward in a direction of a side portion thereof.

In the conventional package bag, the pouring nozzle is protruded in a horizontal direction from the side portion of the bag body, so that the packed liquid material is poured out even in a slight tilting and hence the liquid draining is deteriorated unavoidably. On the contrary, the package bag according to the invention is necessary to be tilted at a big angle as compared to the conventional package bag, so that the packed liquid material poured out from the top opening port of the pouring nozzle becomes small in a force flowing along the opening port (travelling force). Furthermore, a force dragging the non-poured liquid material located in the pouring path into the inside of the package bag (negative pressure) becomes large. In the package bag according to the invention, therefore, the liquid draining property is improved during the pouring of the packed liquid material and in the returning of the package bag to the standing state for stopping the pouring of the packed liquid material, and at the same time there is no fear of staying the packed liquid material at a state adhered to the top opening port of the pouring nozzle.

According to the invention, fears of generating the liquid dripping and contaminating the package bag and the surrounding thereof can be removed effectively.

Further, the horizontal part including the tear opening portion is arranged in the pouring nozzle according to the invention, so that when the packed liquid material is flown from the filling space of the package bag body to the checking type pouring nozzle, the packed liquid material is rectified in the horizontal part to run toward the tear opening portion in laminar flow. As a result, the packed liquid material does not spatter in an unexpected direction, and also the pouring amount of the packed liquid material can be easily controlled by adjusting the inclination angle of the package bag.

In the package bag according to the invention, when the upward inclination angle of the pouring nozzle is made to 25-70° as an angle θ between the widthwise central line of the pouring path in the inclined part protruding from the upper end of the package bag body obliquely upward and the upper end of the package bag body, the liquid draining property of the packed liquid material can be improved irrespectively of the inclination angle of the package bag to suppress the occurrence of liquid dripping and also the packed liquid material can be poured into a required position in a higher pouring accuracy.

In the invention, the shape of the opened end of the horizontal part formed by tearing the tip portion located at a side opposite to the inclined part, for example, along the notch or tear-guiding scar is made to be straight or curved in accordance with the upward inclination angle of the pouring nozzle, kind of the packed liquid material, use application and so on. (Moreover, when the opened end is curved, it is preferable to be curved so as to protrude toward a pouring direction of the packed liquid material.) In this case, even if the amount of the packed liquid material retained in the package bag is decreased to lose pouring, the packed liquid material falls down along the opened end of the curved form and dropped off from a narrow zone of the protruded end (one point), so that the liquid draining is further improved and the packed liquid material is not retained at a state adhered to the top opened port, and hence the fear of generating the liquid dripping and contaminating the package bag and the surrounding thereof can be removed.

In the invention, when the shape of the opened end in the top of the horizontal part is made to a wave being concave in both end portions and convex in a central portion with respect to the pouring direction, the flexibility of the central portion in the opened end is increased by releasing from restrain through peripheral sealed part located at the both end portions of the opened end, and the adhesion or peeling of mutual inner faces in the pouring path of the pouring nozzle is attained rapidly and surely to largely improve the draining of the packed liquid material.

According to the invention, when a ratio of the opened width formed by tearing the top portion of the pouring nozzle to the path width in the base end portion of the pouring path is made to be within a range of 1:1 to 1:10, the self-sealing function can be developed effectively, while the occurrence of liquid dripping can be prevented effectively without spattering the packed liquid material.

In the invention, when the pouring nozzle is subjected to folding habit at a position of a boundary portion between the inclined part and the horizontal part or the vicinity thereof to form a folded part for temporarily stopping a packed liquid material flown into the inclined part to prevent leakage thereof in an unexpected occurrence under an unpressed condition, leakage of a great amount of the packed liquid material can be prevented even if the package bag falls down accidentally after the top portion of the pouring nozzle is opened by tearing.

In the package bag according to the invention, the leakage-preventing pleat of at least one concave-convex formed by bending the laminate films extended in a direction across the pouring path in a zigzag form is arranged on the front and rear laminate films constituting the pouring nozzle, preferably on the vicinity of the base end portion of the nozzle. In this case, the elastic restoring force through the concave-convex pleat is increased and the adhesion between the mutual laminate films is attained rapidly and surely when the pouring of the packed liquid material is stopped to return the package bag to the standing state, whereby the self-sealing function can be developed effectively, while the pouring nozzle can be closed by the concave-convex pleat. For example, if the package bag accidentally falls down after the opening of the pouring nozzle, the concave-convex pleat plays a role as a cap and develops an effect of preventing leakage of the packed liquid material.

EMBODIMENTS FOR CARRYING OUT THE INVENTION

An embodiment of the invention will be described with reference to the accompanying drawings below.

Figure 1:
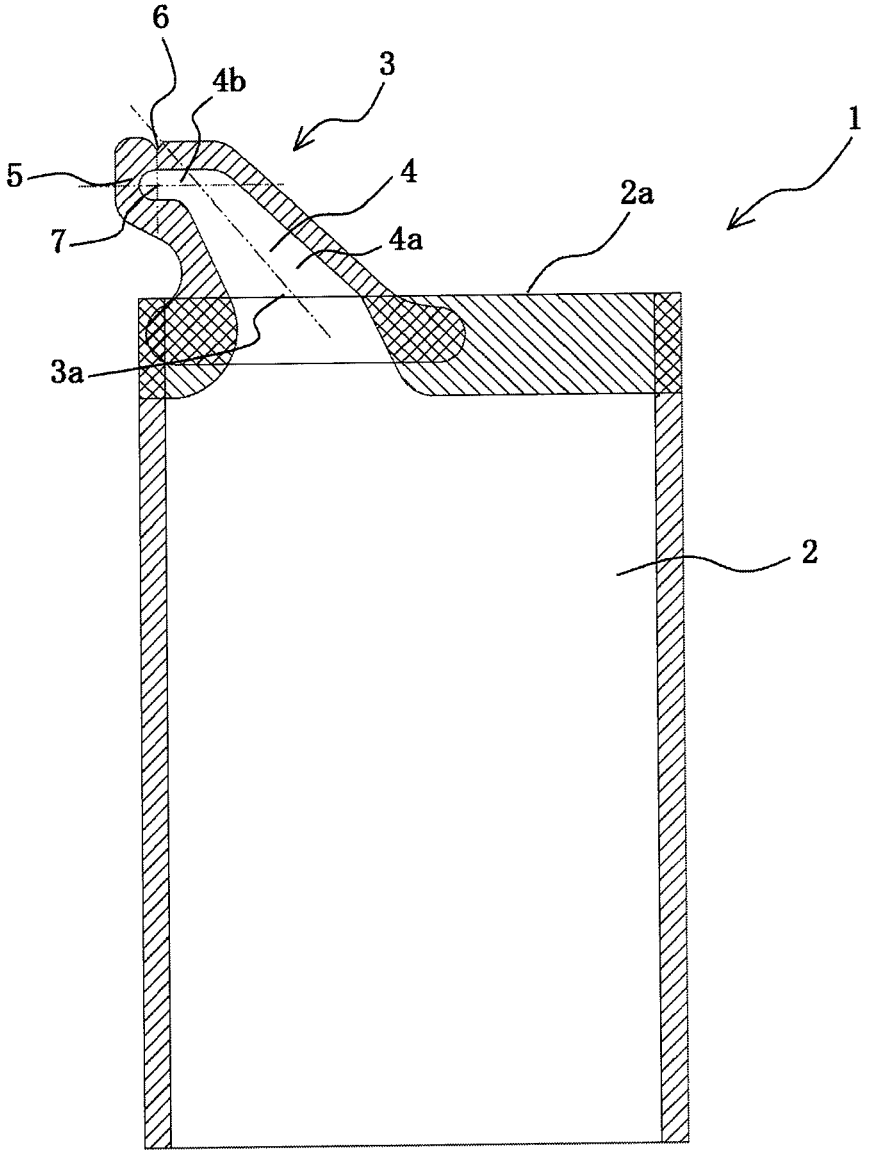
FIG. 1 is a front view illustrating an embodiment of the package bag according to the invention.

A package bag 1 shown in FIG. 1 comprises a package bag body 2 and a checking type film-shaped pouring nozzle 3 communicating with the package bag body 2 and having a self-sealing function, which are integrally united, for example, by fusion-joining an outermost sealant layer in a base end portion of the pouring nozzle 3 to a sealant layer in an inner face of an upper end portion of the package bag body 2 at a posture of protruding obliquely upward to a side portion of the package bag body 2.

The pouring nozzle 3 is constructed with a pair of front and rear thin laminate films each frequently having a three layer structure comprised of a. a thermoplastic oriented base film layer such as uniaxially or biaxially-oriented PET layer or NY layer having a thickness of 5-40 μm and b. sealant layers sandwiching the oriented base film layer therebetween such as non-oriented PE layers or PP layers having a thickness of 5-80 μm.

That is, the pouring nozzle 3 can be constructed by mutually fusion-joining front and rear thin laminate films having the same contour shape or one thin laminate film folded at its central portion or the like into front and rear parts at opposing postures of the mutual sealant layers, for example, through heat sealing of peripheral portions other than a base end side to define a pouring path 4 in the central portion. In the illustrated pouring nozzle 3, a top end portion 5 is cut off at a position of a V-shaped notch portion 6 by tearing or the like to form a top opening port 7 in the pouring path 4.

In the package bag 1, when a packed liquid material is poured out from the bag, the top opening port 7 is formed in the pouring path 4 of the pouring nozzle 3 by tearing and removing the top end portion 5 of the pouring nozzle 3 as previously mentioned. The required pouring of the packed liquid material can be performed by tilting the package bag 1 at such a state to largely separate away opposite inner faces of the pouring path 4 through hydraulic head pressure of the packed liquid material or the like to thereby release the top opening port 7. In this case, the pouring can be performed by contracting or crushing deformation of the package bag body 2 in accordance with the volume of the packed liquid material poured without introducing ambient air into the package bag 1.

When the pouring of the packed liquid material is stopped, the package bag 1 is returned to a standing state, and at the same time, the pouring path 4 is released from hydraulic head pressure of the packed liquid material or the like and returned to its original form under generation of negative pressure based on the returning of the packed liquid material to the inside of the package bag body 2 and further the mutual inner faces wetted under interposition of thin film of the packed liquid material are negatively adsorbed under an assist of reduced-pressure atmosphere of the package bag body 2 inside to automatically close the pouring path 4, whereby the self-sealing function for preventing penetration of ambient air into the inside of the package bag 1 can be automatically developed in the pouring nozzle 3.

Therefore, the package bag 1 is sufficiently protected from contacting with ambient air before, during and after the pouring of the packed liquid material and hence the oxidation, contamination and the like of the packed liquid material in the bag can be prevented effectively.

In the package bag 1 provided with the checking type pouring nozzle 3 having such a self-sealing function, the invention lies in a feature that the pouring nozzle 3 is arranged at a posture of protruding obliquely upward from the upper end of the package bag body 2 toward the side portion thereof.

Figure 2:
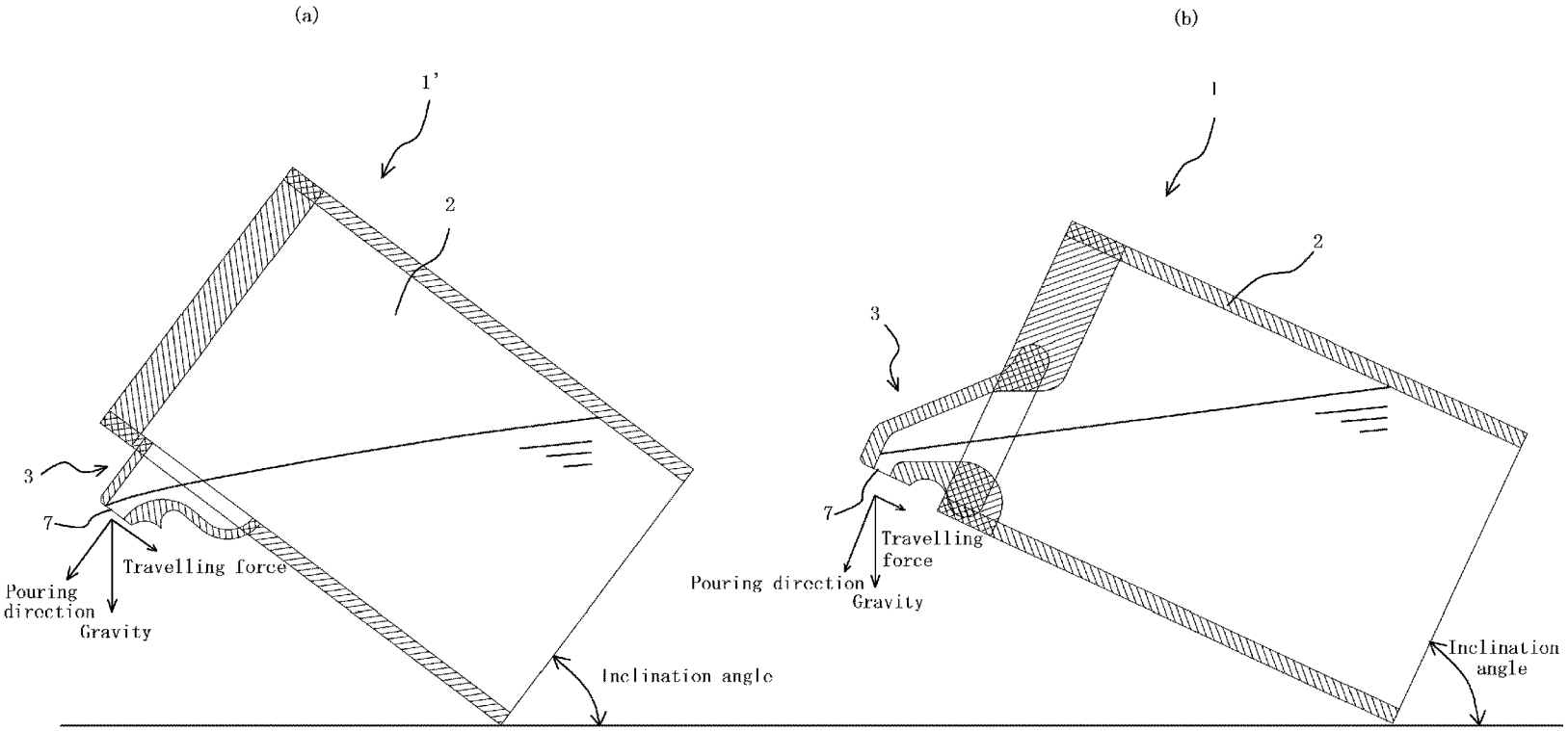
FIG. 2 is a schematic view showing a comparison in a tilting state at a start of pouring a packed liquid material between the conventional package bag (a) and the package bag according to the invention (b).

As shown in FIG. 2, the position of the top opening port 7 in the pouring nozzle 3 becomes higher than a position of a top opening port of a package bag 1' formed by protruding the conventional pouring nozzle 3 from the side portion of the package bag body 2, so that the package bag 1 is required to be largely tilted as compared to the conventional case in the pouring of the packed liquid material. Moreover, FIG. 2 shows a comparison between the conventional package bag 1' (FIG. 2(*a*)) and the package bag 1 of the invention (FIG. 2(*b*)) at a tilting state in pouring start of the packed liquid material.

In the package bag 1 of the invention, the pouring is performed by making the inclination larger as compared with the conventional package bag 1' provided on an upper end of its side portion with the pouring nozzle 3, so that a force in a direction along an end face of the top opening port 7, i.e., in a direction of travelling the packed liquid material along a lower end of the top opening port 7 becomes smaller in the package bag 1 of the invention, and the packed liquid material poured out separates from the end face of the top opening port 7 of the nozzle by gravity and drops down without travelling along the top opening port 7. In the package bag 1 of the invention, therefore, the liquid draining property is good and there is no risk of adhering the packed liquid material to the top opening port 7 or causing liquid dripping.

In the package bag 1 of the invention, even in the case of stopping the pouring of the packed liquid material, an inclination angle for stopping the pouring (ending angle) is approximately equal to an inclination angle for pouring out the packed liquid material (starting angle), so that when the package bag 1 is returned to a standing state, the packed liquid material pushed out from the vicinity of the top opening port 7 separates away and drops down from the end face of the top opening port 7 without travelling along the top opening port 7, and at the same time, the packed liquid material is not retained at a state of adhering to the top opening port 7. Therefore, the occurrence of liquid dripping can be suppressed effectively.

In the pouring nozzle 3, a horizontal part 4*b* parallel to the upper end 2*a* of the package bag body 2 is provided on an extending portion of an inclination part 4*a* of the pouring path 4 (at a side of a free end portion of the pouring nozzle 3). When such a horizontal part 4*b* is arranged, the packed liquid material flown into the inclined part 4*a* of the pouring path 4 side the base end portion 3*a* of the nozzle by tilting of the package bag is introduced into the horizontal part 4*b* narrower than and parallel to the inclined part 4*a* and rectified and directed to the top opening port 7 in laminar flow. As a result, the packed liquid material does not spatter in an unexpected direction and is excellent in the liquid draining property, and especially the amount of the packed liquid material poured can be controlled by adjusting the inclination angle of the package bag. Moreover, the pouring flow of the packed liquid material is rectified as the horizontal part 4*b* becomes longer, and the packed liquid material can be poured out in a target direction with a high precision.

Figure 4:
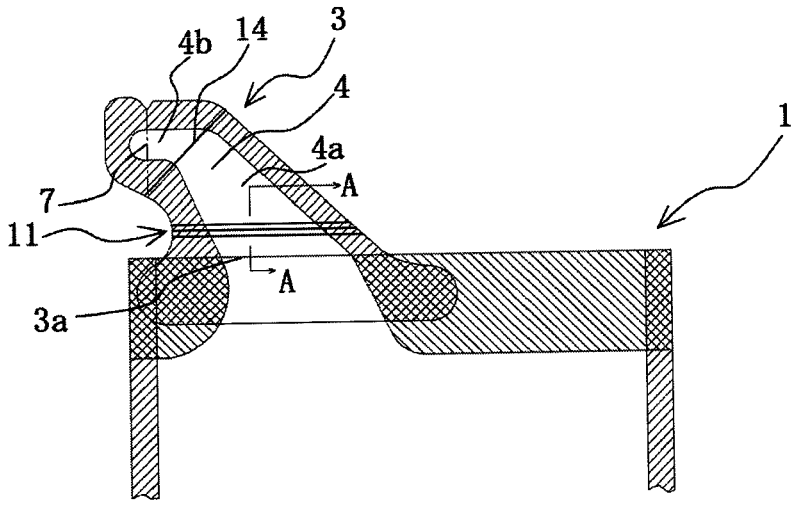
FIG. 4(*a*) is a partial schematic view illustrating a case of forming concave-convex pleat in a pouring nozzle and FIG. 4(*b*) is a sectional view taken along a line A-A.
Figure 4:
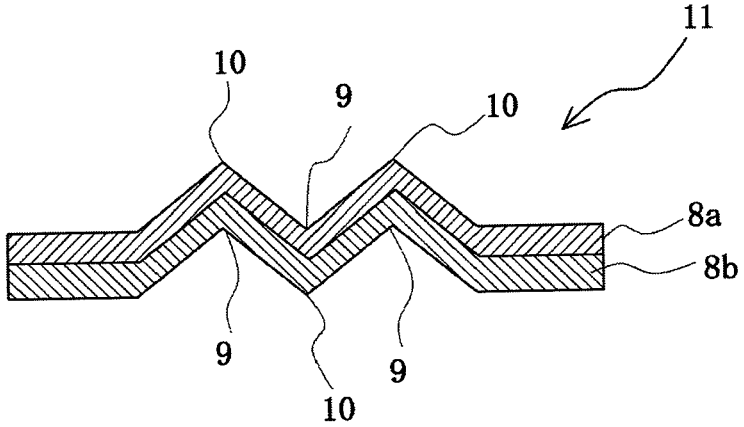
Figure 5:
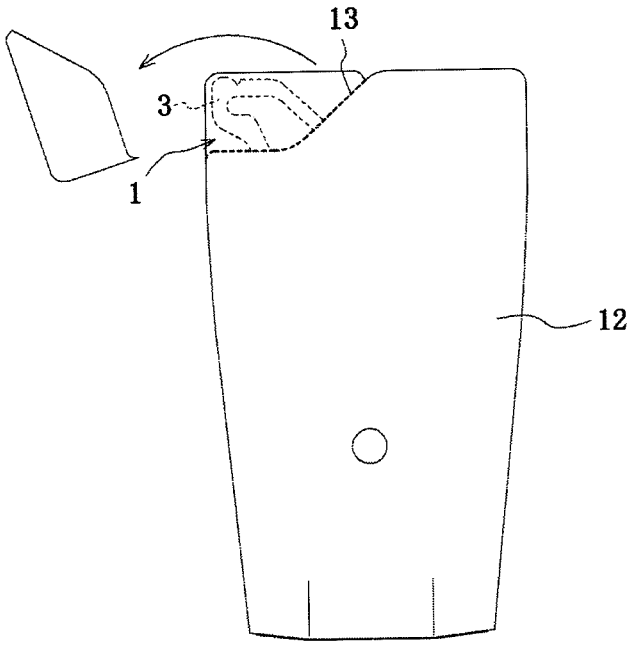
FIG. 5(*a*) is a front view illustrating a state of housing and holding a package bag according to the invention in an outer container, and FIG. 5(*b*) is a front view illustrating a state of pouring out a packed liquid material by tilting an outer container.
Figure 5:
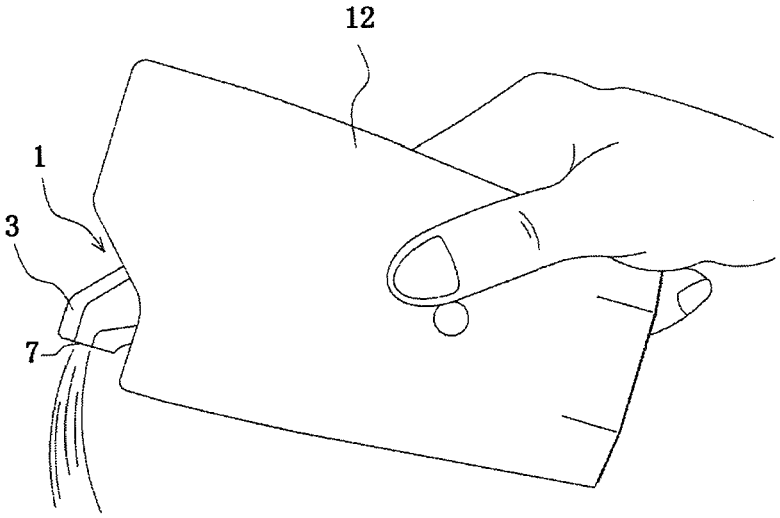

Moreover, the pouring nozzle 3 comprises the inclined part 4*a* and the horizontal part 4*b* folded from the free end portion of the inclined part 4*a* at approximately 90°. As shown in FIG. 4, it is preferable that a fold habit is formed in a boundary portion between the inclined part 4*a* and the horizontal part 4*b* or in the vicinity thereof so as to traverse the pouring path 4 to provide a folded part 14 for preventing leakage. According to the leakage preventing folded part 14, when the pouring pressure of the packed liquid material flown into the inclined part 4*a* is small, the pouring path 4 can be closed to temporarily hold the flow of the packed liquid material and hence there is no fear of leaking out a great amount of the packed liquid material even if the package bag 1 is fallen down accidentally. This function effect can be developed more effectively when the package bag 1 is housed and held, for example, in an exterior vessel made from a plastic, paper or the like as shown in FIG. 5.

Furthermore, the closed pouring path 4 can be opened by making the inclination angle of the package bag 1 large or by pushing a base of the package bag body 2 (filling space of the packed liquid material) with fingers to increase pouring pressure of the packed liquid material flowing into the pouring path 4. Therefore, an effect capable of minutely controlling the pouring amount of the packed liquid material can be expected by adjusting the inclination angle of the package bag 1 and the pushing pressure to the package bag body 2 with fingers.

Moreover, the upper inclination angle of the pouring nozzle 3 defined by an angle θ between widthwise central line α of the inclined part 4*a* of the pouring path 4 and an upper end 2*a* of the package bag body 2 is preferable to be a range of 25-70°, preferably 40-60°. The effects such as liquid draining property, pouring direction and the like can be developed more effectively within the above range.

When the inclination angle θ is less than 25°, the top opening port 7 of the pouring nozzle 3 becomes too near to the upper end 2*a* of the package bag body 2 and hence the packed liquid material adheres to the package bag body 2 or there is a fear that the packed liquid material cannot be poured out toward the predetermined direction. When the inclination angle θ exceeds 70°, it is necessary to largely tilt the package bag 1 in the pouring of the packed liquid material, so that the packed liquid material inside the package bag 1 flows into the pouring path 4 of the pouring nozzle 3 at a breath and the pouring amount cannot be adjusted, or the packed liquid material cannot be poured out in the predetermined direction and there is a fear of contaminating the surroundings due to spattering.

In the pouring nozzle 3, a ratio of an opening width a of the top opening port 7 to a path width b of the pouring path 4 in the base end portion 3*a* of the nozzle (a:b) is preferably within a range of 1:1-1:10, more preferably within a range of 1:1-1:6. According to such a construction, the self-sealing function can be developed more effectively, and the pouring of the packed liquid material can be made smooth and the occurrence of liquid dripping can be prevented effectively without spattering the packed liquid material.

In the pouring nozzle 3, the top opening port 7 is formed by tearing along the tear-guiding scar instead of the notch portion 6 as mentioned above. The shape of the opened edge formed by tearing along the notch portion 6 or the tear-guiding scar is straight or curved. When the shape of the opened edge is straight, the edge may be vertical to the upper end 2*a* of the package bag body 2 at a standing posture of the package bag 1, or the lower end of the edge may be inclined side the top portion 5 or the base end portion 3*a* of the pouring nozzle 3. This is properly selected in accordance with the upward inclination angle of the pouring nozzle 3, kind of the packed material and so on.

Figure 3:
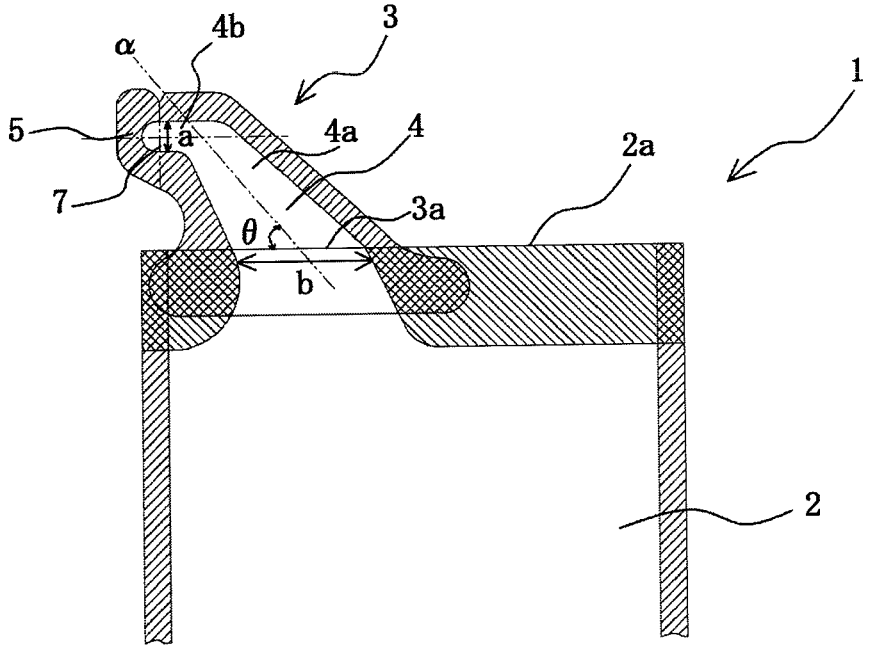
FIG. 3(*a*) is a schematic view illustrating an upward inclination angle θ of a pouring nozzle, and FIG. 3(*b*) and FIG. 3(*c*) are partial schematic views illustrating a shape of an opened end in a top opening port of a pouring nozzle.
Figure 3:
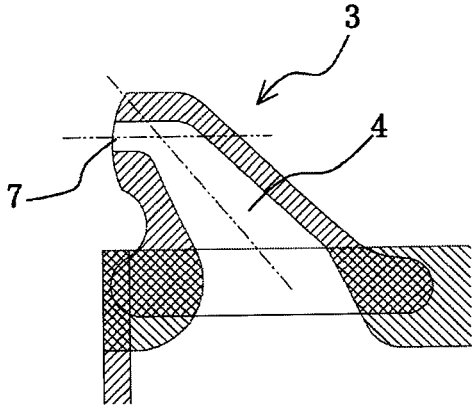
Figure 3:
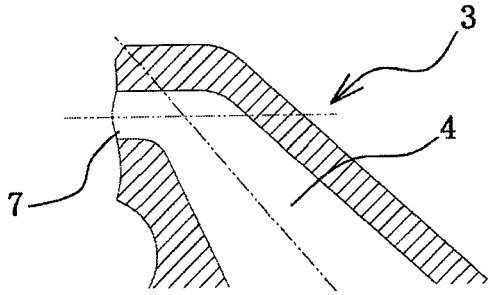

When the shape of the opened edge in the top of the pouring nozzle is curved, it is preferable to be curved so as to protrude in the pouring direction of the packed liquid material as shown in FIG. 3(*b*). In this case, the packed liquid material travels along the opened end of the curved form and drops down from one point of the protruded tip position even if the amount of the packed material retained in the bag is decreased to make the pouring flow weak, so that the liquid draining property is improved and the occurrence of the liquid dripping or the like can be prevented effectively.

As shown in FIG. 3(*c*), when the shape of the opened edge is made concave in the both end portions 7*a* with respect to the pouring direction and convex in the central portion 7*b*, the central portion 7*b* of the opened edge is softened by releasing from restraint with the peripheral sealing portion of the pouring nozzle 3 located at the both end portions 7*a* of the opened edge, and the opening and closing of the top opening port 7 can be made rapidly and surely to more improve the liquid draining property.

In such a package bag 1, it is preferable to fill and pack the packed liquid material, for example, under air removal through seal filling in liquid or at a state of diffusing microbubbles of nitrogen, carbon dioxide gas or the like (diameter: about 1 μm to 150000 μm) into the packed liquid material. When the gas such as nitrogen, carbon dioxide or the like is filled in the package bag 1, the adhesion force between the mutual inner faces of the package bag body 2 is mitigated by such a gas, while the flowing of the packed liquid material is introduced (replaced) into the space occupied by the gas, whereby the packed liquid material can be poured smoothly and the amount of the packed liquid material retained in the bag can be decreased.

A gas encapsulated in the package bag body 2 together with the packed liquid material is preferable to be selected in accordance with the kind of the packed liquid material. Particularly, when the packed liquid material is easily oxidized or contaminated by air (seasoning liquid such as soy source, oils, cosmetics, medicines and so on), it is preferable to use an inert gas such as nitrogen, carbon dioxide or the like. When the quality of the packed liquid material is not deteriorated by contacting with a constant amount of an active gas (for example, various alcohols and so on), an active gas such as oxygen, diluted air or the like may be used. Especially, since the pouring nozzle 3 has the self-sealing function as previously mentioned, the penetration of ambient air into the inside of the package bag body 2 is blocked by the pouring nozzle 3, so that the growth of aerobic bacteria can be suppressed effectively in the package bag body 2. On the other hand, an amount of dissolved oxygen becomes smaller in the bag body 2, so that there is a fear of growing anaerobic bacteria such as botulinum and perfringens. As a countermeasure to such a problem, according to the invention, carbon dioxide gas or a mixed gas of carbon dioxide gas and nitrogen gas having a bacteriostatic effect is encapsulated together with the packed liquid material, whereby pH of the packed liquid material can be lowered to suppress the growth of anaerobic bacteria effectively.

In the invention, it is preferable that a leakage-preventing pleat 11 of at least one concave-convex 9, 10 formed by bending the laminate films 8*a*, 8*b* extended in a direction across the pouring path 4 of the pouring nozzle 3 in a zigzag form as shown by a section view (FIG. 4(*b*)) in A-A section of FIG. 4(*a*) is disposed on the laminate films 8*a*, 8*b* constituting the pouring nozzle 3 as shown in FIG. 4, preferably at a position near to the base end portion 3*a* of the nozzle.

When such a leakage-preventing pleat 11 is used, elastic returning force of the laminate film 8*a*, 8*b* to the original form is increased, so that even if the package bag 1 is fallen down wrongly after the opening of the top end portion 5 of the pouring nozzle 3, a fear of leaking out the packed liquid material from the top opening port 7 can be prevented by the leakage-preventing pleat 11. Furthermore, the adhesion between the mutual inner faces of the pouring path 4 is attained rapidly and surely by the leakage-preventing pleat 11, so that the self-sealing function can be developed effectively when the pouring of the packed liquid material is stopped to return the package bag 1 to a standing state.

Especially, when the gas is encapsulated in the package bag body 2 together with the packed liquid material as mentioned above, there is a fear that the gas is promoted into the pouring path 4 of the pouring nozzle 3 to block the adhesion between the mutual inner faces of the pouring path 4, so that the formation of the leakage-preventing pleat 11 is effective.

Since the package bag 1 itself doesn't have a self-standing property, it is preferable to give a self-standing property by housing in an exterior vessel made from a paper, plastic or earthenware in use. As the exterior vessel is preferably used an exterior vessel 12 as shown, for example, in FIG. 5, which has substantially the same form as a package of filling and packing the packed liquid material in the package bag 1 and is cylindrical in the lower portion and plate-like in the upper portion. Moreover, the exterior vessel 12 has a tear-guiding scar 13 at a position corresponding to the pouring nozzle 3 in the internal package bag 1. By tear-opening along the tear-guiding scar 13 is exposed the pouring nozzle 3 located at the inside outward and then the exterior vessel 12 is tilted so as to direct the top opening port 7 of the pouring nozzle 3 downward as shown in FIG. 5(*b*) 5(*c*), whereby the required pouring can be performed.

EXAMPLE

In this example, a pouring start angle of a packed liquid material (inclination angle of a bottom of a package bag) and the presence or absence of an occurrence of liquid dripping after the pouring of the packed liquid material are measured by using a package bag of Invention Example formed by protruding a pouring nozzle from an upper end portion of a package bag body obliquely upward and a package bag of Comparative Example formed by protruding a pouring nozzle from a side portion of a package bag body when an amount of a packed liquid material retained in a package bag is changed in each of the package bags. As the package bag is used a bag having a capacity of 500 ml. The results are shown in Table 1.

TABLE 1

| Invention Example | | | Comparative Example | | |
|---|---|---|---|---|---|
| Amount of packed material in bag | Inclination angle | Liquid dripping | Amount of packed material in bag | Inclination angle | Liquid dripping |
| 150 ml | 75° | absence | 150 ml | 35° | adhered to end face of opening port |
| 30 ml | 100° | absence | 30 ml | 80° | adhered to end face of opening port |

As seen from the results of Table 1, in order to pour the packed liquid material, the package bag is necessary to be largely tilted in Invention Example as compared to Comparative Example, but the packed liquid material is dropped down without travelling along the opening end face of the pouring nozzle. Furthermore, it is confirmed in Invention Example that the liquid draining property is excellent without retaining the packed liquid material at a state of adhering to the opening end face of the pouring nozzle irrespectively of the amount of the packed liquid material retained in the bag.

DESCRIPTION OF REFERENCE SYMBOLS

1: package bag, 2: package bag body, 2*a*: upper end, 3: pouring nozzle, 3*a*: base end portion of nozzle, 4: pouring path, 4*a*: inclined part, 4*b*: horizontal part, 5: top end portion, 6: notch portion, 7: top opening port, 7*a*: central part of opened end, 7*b*: both end portions of opened end, 8*a*, 8*b*: laminate film, 9: concave form, 10: convex form, 11: leakage-preventing pleat, 12: exterior vessel, 13: tear-guiding scar, 14: folded part for preventing leakage

The invention claimed is:

1. A package bag comprising a package bag body formed by joining laminate films each comprised of a base film layer and a sealant layer through fusion of the opposed sealant layers and a film-shaped pouring nozzle having a self-sealing function formed by fusion-joining laminate films each comprised of front and rear sealant layers sandwiching a base film layer at their peripheral portions other than base end portions to form a pouring path communicating to an inside of the package bag body, wherein the base end portion of the film-shaped pouring nozzle is fusion-joined to a top of the package bag body, characterized in that the film-shaped pouring nozzle includes an inclined part located at a side of the base end portion so as to protrude from an upper end portion of the package bag body obliquely upward in a direction of a side portion thereof and a horizontal part connected to a side of a free end portion of the inclined part and extending parallel to the upper end of the package bag body, the pouring path having a pouring path width in the horizontal part that is narrower than a pouring path width in the inclined part, and the horizontal part includes an upper edge of the pouring path and a lower edge of the pouring path, the upper edge of the pouring path and the lower edge of the pouring path in the horizontal part being parallel to the upper end of the package bag body.

2. A package bag according to claim 1, wherein the inclined part has an angle θ between a widthwise central line of the pouring path and the upper end of the package bag body of 25-70°.

3. A package bag according to claim 1, wherein the horizontal part is provided with a notch or a tear-guiding scar for opening a pouring port in the vicinity of a tip portion located at a side opposite to the inclined part.

4. A package bag according to claim 1, wherein a shape of an opened end of the horizontal part formed by tearing the vicinity of a tip portion located at a side opposite to the inclined part is straight or curved.

5. A package bag according to claim 4, wherein the opened end is concave at end portions and convex at a central portion with respect to a pouring direction of a packed liquid material.

6. A package bag according to claim 1, wherein a ratio of an opening width in the horizontal part formed by tearing a tip portion located at a side opposite to the inclined part to a path width of the pouring path at the base end portion of the film-shaped pouring nozzle is within a range of 1:1 to 1:10.

7. A package bag according to claim 1, wherein the film-shaped pouring nozzle is provided in a boundary portion between the inclined part and the horizontal part or in the vicinity thereof with a folded part for temporarily stopping a packed liquid material flown into the inclined part to prevent leakage thereof in an unexpected occurrence under an unpressed condition.

8. A package bag according to claim 1, wherein the film-shaped pouring nozzle is provided in a position of either the horizontal part or the inclined part or in a boundary thereof with a leakage-preventing pleat of at least one concave-convex formed by bending the laminate films extended in a direction across the pouring path in a zigzag form.

* * * * *